US008821323B2

(12) United States Patent
Liu et al.

(10) Patent No.: US 8,821,323 B2
(45) Date of Patent: Sep. 2, 2014

(54) SWING TRAINER FOR EXERCISE

(71) Applicants: Chiang Liu, Changhua Hsien (TW); Shih-Heng Chen, Changhua Hsien (TW)

(72) Inventors: Chiang Liu, Changhua Hsien (TW); Shih-Heng Chen, Changhua Hsien (TW)

(73) Assignee: Da Chin Enterprise Co., Ltd., Changhua Hsien (TW)

( * ) Notice: Subject to any disclaimer, the term of this patent is extended or adjusted under 35 U.S.C. 154(b) by 80 days.

(21) Appl. No.: 13/714,778

(22) Filed: Dec. 14, 2012

(65) Prior Publication Data

US 2014/0171231 A1 Jun. 19, 2014

(51) Int. Cl.
*A63B 69/00* (2006.01)
*A63B 59/06* (2006.01)

(52) U.S. Cl.
CPC ..... *A63B 69/0002* (2013.01); *A63B 2069/0008* (2013.01); *A63B 59/06* (2013.01)
USPC ..... 473/457; 473/422; 473/437; 473/564

(58) Field of Classification Search
CPC .... A63B 69/00; A63B 69/0002; A63B 69/38; A63B 59/06; A63B 15/00; A63B 15/005; A63B 2069/00; A63B 2069/0002; A63B 2069/0008
USPC ..... 473/422, 437, 457, 459, 446, 519, 564, 473/521; 482/93, 109
See application file for complete search history.

(56) References Cited

U.S. PATENT DOCUMENTS

| | | | | | |
|---|---|---|---|---|---|
| 4,555,111 | A * | 11/1985 | Alvarez | ..... | 473/457 |
| 4,819,935 | A * | 4/1989 | Dirksing et al. | ..... | 473/457 |
| 5,577,966 | A * | 11/1996 | Duran | ..... | 473/457 |
| 6,050,908 | A * | 4/2000 | Muhlhausen | ..... | 473/457 |
| 6,561,930 | B2 * | 5/2003 | Mabry | ..... | 473/457 |
| 6,569,042 | B2 * | 5/2003 | LaChance et al. | ..... | 473/457 |
| 7,147,580 | B2 * | 12/2006 | Nutter et al. | ..... | 473/457 |
| 7,557,286 | B2 * | 7/2009 | Capotosto | ..... | 482/109 |
| 7,794,340 | B2 * | 9/2010 | Mauer et al. | ..... | 473/457 |
| 8,523,714 | B2 * | 9/2013 | Thackeray | ..... | 473/457 |
| 8,641,560 | B2 * | 2/2014 | Vignola | ..... | 473/457 |
| 2005/0261075 | A1 * | 11/2005 | Pullaro | ..... | 473/457 |
| 2007/0254751 | A1 * | 11/2007 | Wilson | ..... | 473/457 |
| 2008/0113832 | A1 * | 5/2008 | Ciesar et al. | ..... | 473/457 |
| 2010/0041500 | A1 * | 2/2010 | Whitney et al. | ..... | 473/457 |
| 2010/0234144 | A1 * | 9/2010 | Sutlovich et al. | ..... | 473/457 |
| 2012/0035004 | A1 * | 2/2012 | Flores | ..... | 473/457 |

* cited by examiner

*Primary Examiner* — Mitra Aryanpour
(74) *Attorney, Agent, or Firm* — Alan Kamrath; Kamrath IP Lawfirm, P.A.

(57) ABSTRACT

A swing trainer for exercise contains a handle having a first end and a second end relative to the first end, and the second end having a screw rod; a body having a first segment and a second segment relative to the first segment, the first segment fitting with the second end of the handle, and the screw rod being inserted into the body, between the first segment and the second segment being axially defined a defining rail; a counterweight block fixed in the body, the counterweight block having a first screw orifice defined thereon to screw with the screw rod of the handle and a slot axially defined on a side of an outer surface thereof to match with the defining rail of the body; a limiting member for limiting a connection of the handle and the body so that the handle moves relative to the body.

8 Claims, 5 Drawing Sheets

SWING TRAINER FOR EXERCISE

BACKGROUND OF THE INVENTION

1. Field of the Invention

The present invention relates to a swing trainer and, more particularly, to a swing trainer for exercise that is adjusted easily based on using requirements.

2. Description of the Prior Art

Baseball and softball sports including movements of pitching, hitting, base running, and passing. Hitting and base running may get scores to win the game.

To train a hitting skill, a user can hit baseballs pitched from a pitching machine, or the baseball or the softball is placed on a batting seat to be hit. In addition, a swing weight is fitted on a hitting end of a bat to increase a weight of the bat, thus training swing force and speed. However, such a swing weight is fixed on the hitting end of the bat without being adjustable based on using requirements. Therefore, users with different arm forces cannot adjust a fixing position of the swing weight on the bat to grow muscles and to improve hitting skill. Furthermore, since the swing weight is fitted on the hitting end of the bat, the swing weight slides on the swinging bat randomly, damaging the baseball.

The present invention has arisen to mitigate and/or obviate the afore-described disadvantages.

SUMMARY OF THE INVENTION

The primary object of the present invention is to provide a swing trainer for exercise in which a body and a handle are capable of being rotated relative to each other. A counterweight block axially moves toward a desired position along the body. The farther the counterweight block is away from the handle, the greater the swing force applied by a user, while the closer the counterweight block moves toward the handle, the less the swing force applied by the user, based on the lever principle. Accordingly, the swing trainer is capable of being adjusted to be applicable for different users with a different swing force and for growing different users' muscles.

Another object of the present invention is to provide a swing trainer for exercise in which the counterweight block is fixed in the body and is screwed with a screw rod of the handle. The body and the handle are rotated relative to each other so that the counterweight block is driven to axially move along the body. Hence, the counterweight block will not slide randomly and will not damage a baseball.

A swing trainer for exercise in accordance with a preferred embodiment of the present invention contains:

a handle having a first end and a second end relative to the first end, with the second end having a screw rod extending outwardly therefrom;

a body formed in a hollow cylinder shape and having a first segment and a second segment relative to the first segment, with the first segment fitting with the second end of the handle, with the screw rod inserted into the body, with a defining rail axially defined between the first segment and the second segment of the body;

a counterweight block formed in a circular loop shape and fixed in the body, with the counterweight block having a first screw orifice defined on a central position thereof to screw with the screw rod of the handle and a slot axially defined on a side of an outer surface thereof to match with the defining rail of the body; and a limiting member for limiting a connection of the handle and the body, so that the handle moves relative to the body.

DETAILED DESCRIPTION OF THE PREFERRED EMBODIMENTS

Figure 1:
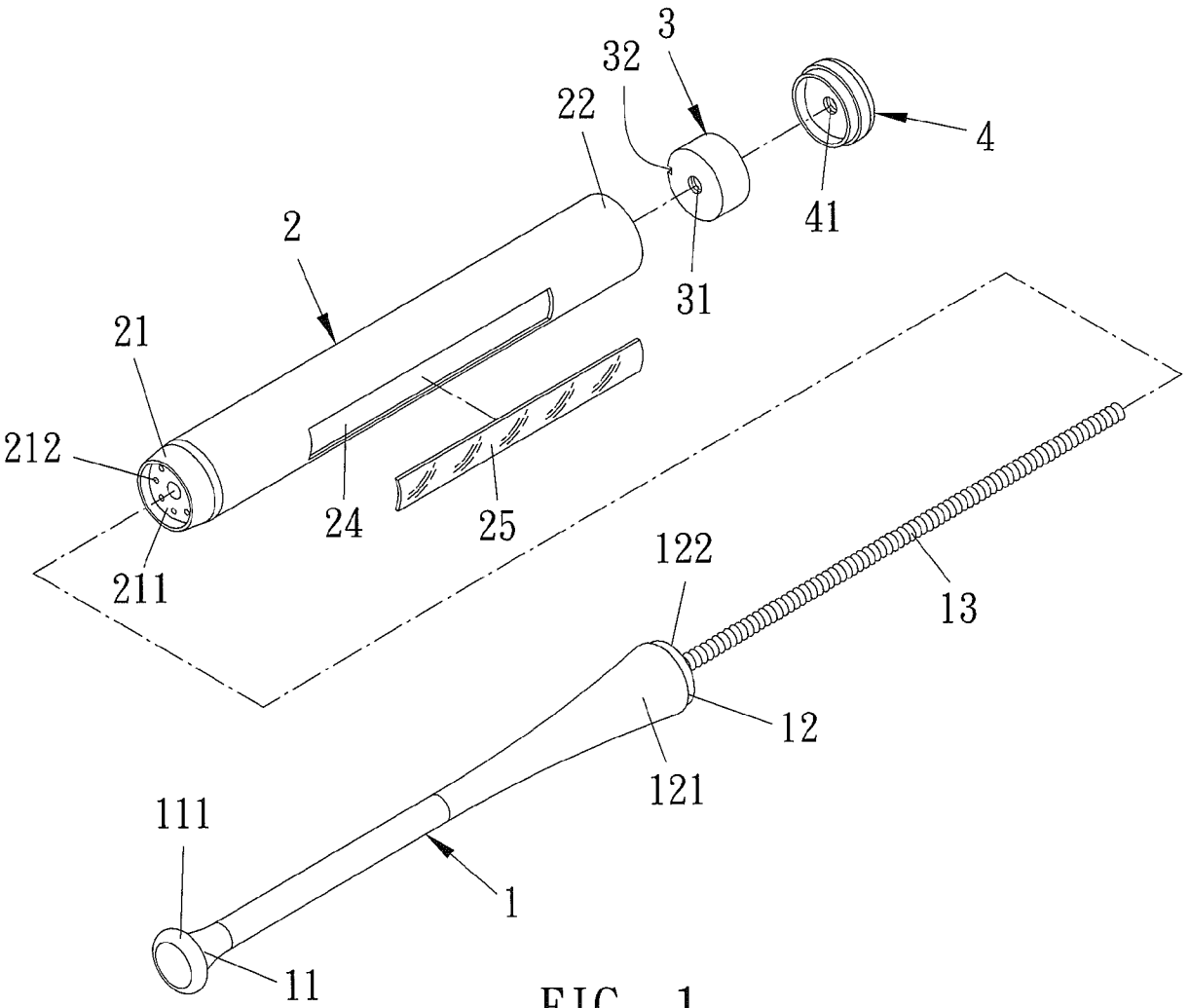
FIG. 1 is a perspective view showing the exploded components of a swing trainer for exercise according to a preferred embodiment of the present invention.
Figure 2:
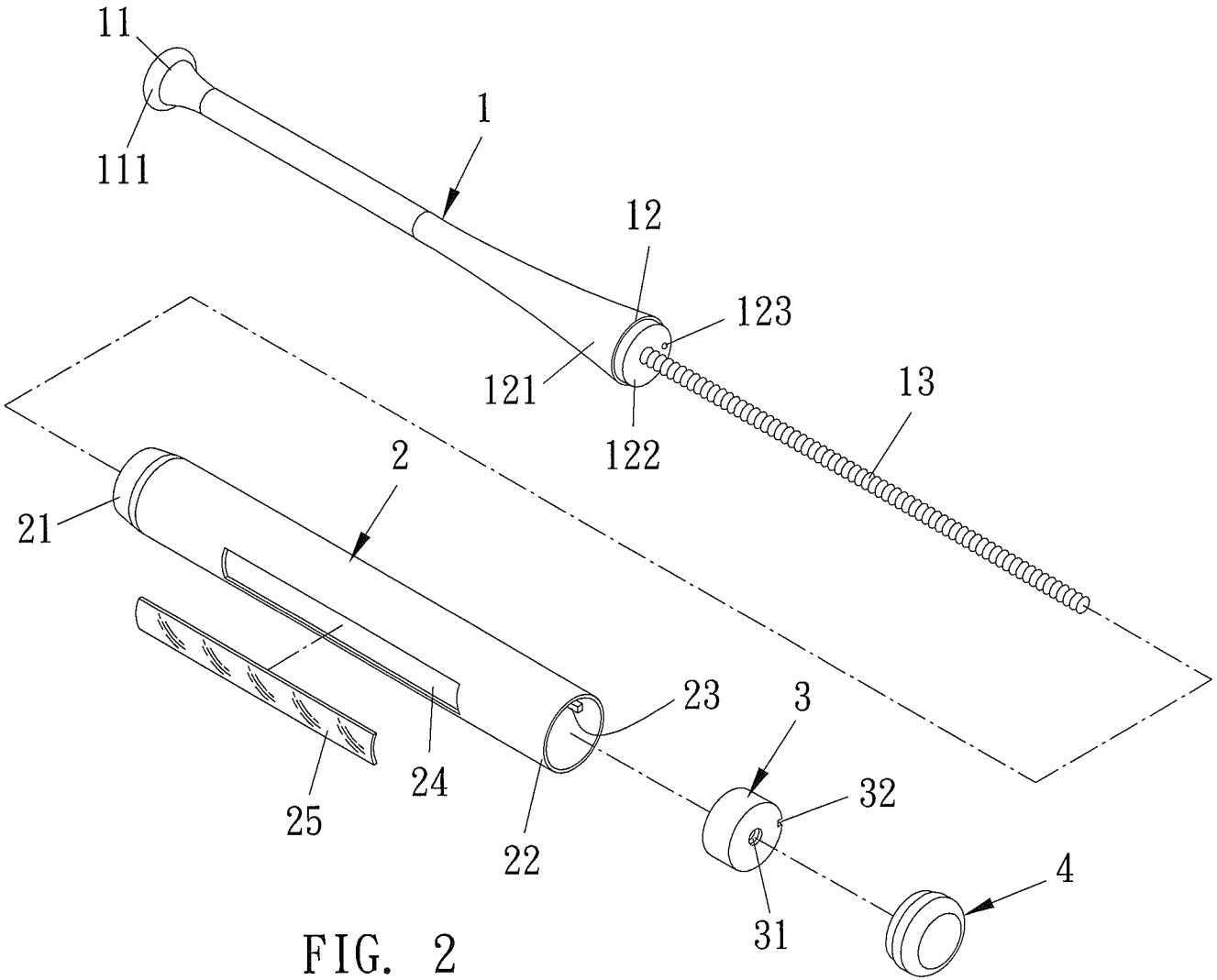
FIG. 2 is another perspective view showing the exploded components of the swing trainer for exercise according to the preferred embodiment of the present invention.
Figure 3:
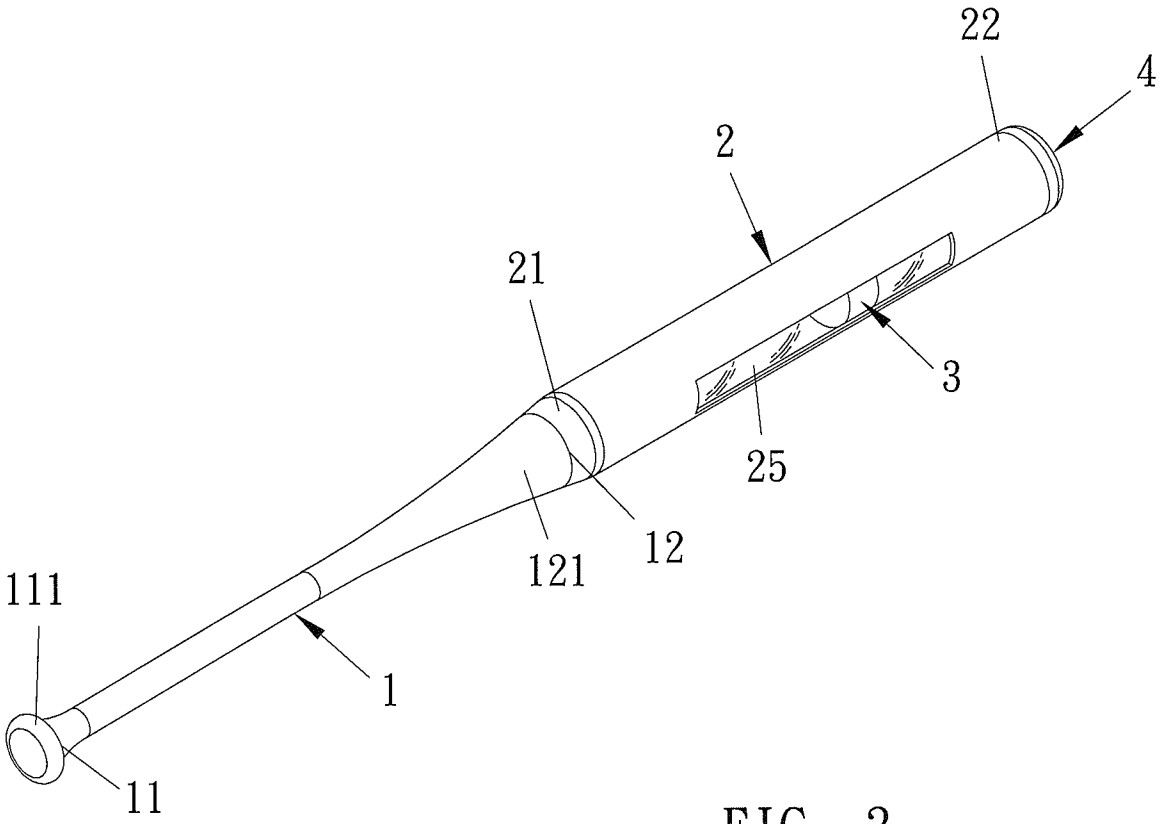
FIG. 3 is a perspective view showing the assembly of the swing trainer for exercise according to the preferred embodiment of the present invention.
Figure 4:
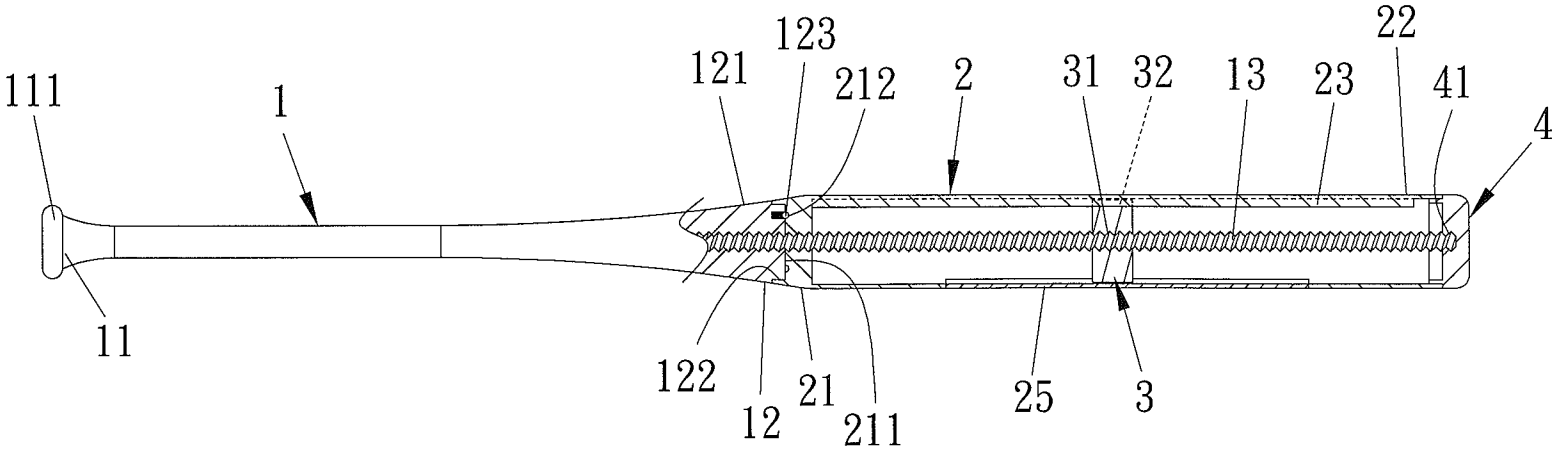
FIG. 4 is a cross sectional view showing the assembly of the swing trainer for exercise according to the preferred embodiment of the present invention.

The present invention will be clearer from the following description when viewed together with the accompanying drawings, which show, for purpose of illustration only, the preferred embodiments in accordance with the present invention.

FIGS. 1-5, a swing trainer for exercise according to a preferred embodiment of the present invention comprises: a handle 1, a body 2, a counterweight block 3, and a limiting member 4. The handle 1 has a first end 11 and a second end 12 relative to the first end 11. The first end 11 has an anti-slip stopping portion 111 formed in a circular shape, and the second end 12 has a neck portion 121 extending outwardly therefrom opposite to the anti-slip stopping portion 111 and a fitting extension 122 formed on the neck portion 121 of the second end 12. The fitting extension 122 has a screw rod 13 extending outwardly from a central position thereof. The body 2 is formed in a hollow cylinder shape and has a first segment 21 and a second segment 22 relative to the first segment 21. The first segment 21 has a recess 211 defined therein to fit with the fitting extension 122, and the screw rod 13 of the handle 1 is inserted into the body 2. Between the first segment 21 and the second segment 22 of the body 2 is axially defined a defining rail 23. The body 2 has an elongated hole 24 axially defined on a side of an outer surface thereof. The elongated hole 24 has a transparent piece 25 covered thereon. The counterweight block 3 is formed in a circular loop shape and is fixed in the body 2. The counterweight block 3 has a first screw orifice 31 defined on a central position thereof to screw with the screw rod 13 of the handle 1 and a slot 32 axially defined on a side of an outer surface thereof to match with the elongated hole 24 of the body 2. The limiting member 4 is a cover for covering the second segment 22 of the body 2 and has a second screw orifice 41 defined in an inner surface thereof to screw with a distal end of the screw rod 13 of the handle 1, so that a connection of the handle 1 and the body 2 is limited, i.e., the handle 1 only allows rotating relative to the body 2.

Between the second end 12 of the handle 1 and the first segment 21 of the body is defined a rotary positioning member. The rotary positioning member includes an abutting unit 123 disposed on the fitting extension 122 of the second end 12 of the handle 1. The abutting unit 123 is an assembly of a spring and a ball in this embodiment. The rotary positioning member also includes a plurality of arcuate notches 212 formed around a bottom end of the recess 211 to abut against the abutting unit 123, so that the body 2 is rotatable relative to the handle 1.

Figure 5:
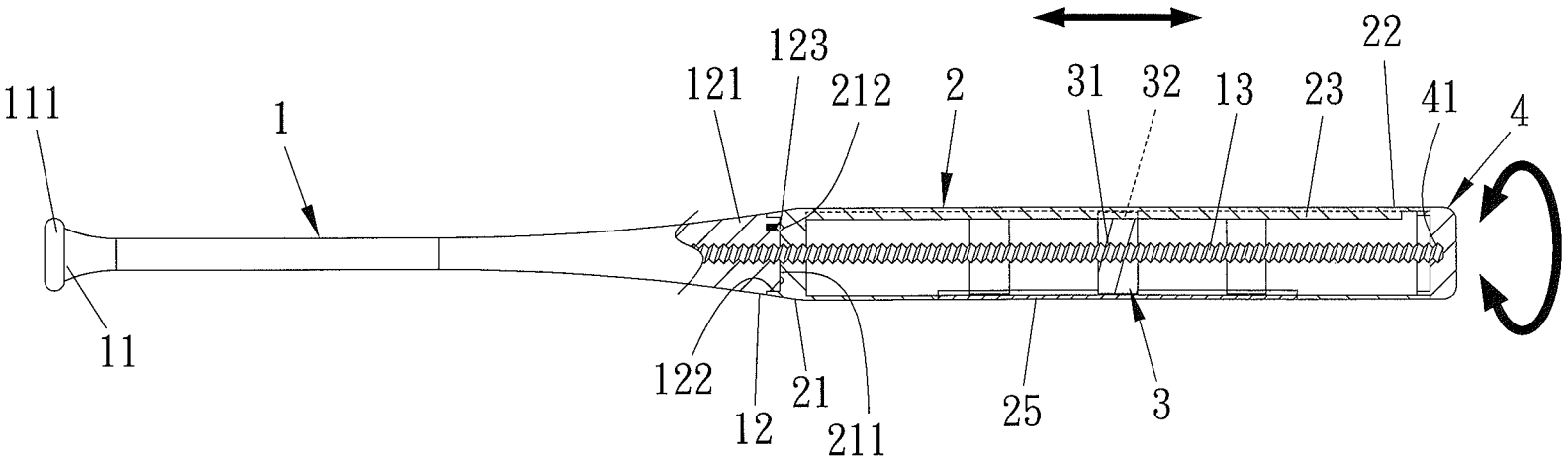
FIG. 5 is a cross sectional view showing the operation of the swing trainer for exercise according to the preferred embodiment of the present invention.

In operation, as shown in FIG. 5, the body 2 is rotated relative to the handle 1. Then, the abutting unit 123 disengages from one of the plurality of arcuate notches 212 and engages with another of the plurality of arcuate notches 212, to have a rotary positioning function between the body 2 and the handle 1. Thereafter, the defining rail 23 of the body 2 drives the counterweight block 3 to rotate, and the first screw orifice 31 of the counterweight block 3 screws with the screw rod 13 of the handle 1, so that the counterweight block 3 moves axially along the body 2, thus adjusting the counterweight block 3 toward a desired position. According to a lever principle, the counterweight block 3 is adjustably moved away from the handle 1, so that a rotary swinging inertia increases to enhance a swing force, or the counterweight block 3 is adjustably moved closer to the handle 1, so that the rotary swinging inertia decreases to reduce the swing force, thus obtaining a hit training requirement.

Thereby, the swing trainer for exercise of the present invention has the following advantages:

1. The body 2 and the handle 1 of the swing trainer are capable of being rotated relative to each other, such that the counterweight block 3 axially moves toward the desired position along the body 2. Thereafter, the farther the counterweight block 3 is away from the handle 1, the greater the swing force applied by a user, while the closer the counterweight block moves toward the handle 1, the less the swing force applied by the user based on the lever principle. Accordingly, the swing trainer is capable of being adjusted to be applicable for different users with a different swing force and for growing different users' muscles.

2. The counterweight block 3 is fixed in the body 2 and is screwed with the screw rod 13 of the handle 1, such that the body 2 and the handle 1 are rotated relative to each other, so that the counterweight block 3 is driven to axially move along the body 2. Hence, the counterweight block 3 will not slide randomly and will not damage a baseball.

While various embodiments in accordance with the present invention have been shown and described, it is clear to those skilled in the art that further embodiments may be made without departing from the scope of the present invention.

What is claimed is:

1. A swing trainer for exercise comprising:

a handle having a first end and a second end relative to the first end, with the second end having a screw rod extending outwardly therefrom;

a body formed in a hollow cylinder shape and having a first segment and a second segment relative to the first segment, with the first segment fitting with the second end of the handle, with the screw rod inserted into the body, with a defining rail axially defined between the first segment and the second segment of the body;

a counterweight block formed in a circular loop shape and fixed in the body, with the counterweight block having a first screw orifice defined on a central position thereof to screw with the screw rod of the handle and a slot axially defined on a side of an outer surface thereof to match with the defining rail of the body; and a limiting member limiting a connection of the handle and the body, wherein the handle moves relative to the body.

2. The swing trainer for exercise as claimed in claim 1, wherein the first end of the handle has a stopping portion formed in a circular shape, and wherein the second end of the handle has a neck portion extending outwardly therefrom opposite to the stopping portion.

3. The swing trainer for exercise as claimed in claim 1, wherein the second end of the handle has a fitting extension formed thereon, and wherein the first segment of the body has a recess defined therein to fit with the fitting extension of the body.

4. The swing trainer for exercise as claimed in claim 1, wherein the body has an elongated hole axially defined on a side of an outer surface thereof, and wherein the elongated hole has a transparent piece covered thereon.

5. The swing trainer for exercise as claimed in claim 1, wherein the limiting member is a cover covering the second segment of the body.

6. The swing trainer for exercise as claimed in claim 5, wherein the cover has a second screw orifice defined in an inner surface thereof to screw with a distal end of the screw rod of the handle.

7. The swing trainer for exercise as claimed in claim 1, wherein between the second end of the handle and the first segment of the body is defined a rotary positioning member.

8. The swing trainer for exercise as claimed in claim 7, wherein the rotary positioning member includes an abutting unit disposed on the second end of the handle and a plurality of arcuate notches formed around a bottom end of the recess to abut against the abutting unit, wherein the body rotates relative to the handle.

* * * * *